US011410581B2

(12) United States Patent
Yamaguchi

(10) Patent No.: US 11,410,581 B2
(45) Date of Patent: Aug. 9, 2022

(54) ELECTRO-OPTICAL APPARATUS

(71) Applicant: Mitsubishi Electric Corporation, Tokyo (JP)

(72) Inventor: Shuzo Yamaguchi, Kumamoto (JP)

(73) Assignee: Trivale Technologies, Santa Clara, CA (US)

( * ) Notice: Subject to any disclaimer, the term of this patent is extended or adjusted under 35 U.S.C. 154(b) by 0 days.

(21) Appl. No.: 17/066,584

(22) Filed: Oct. 9, 2020

(65) Prior Publication Data

US 2021/0125534 A1 Apr. 29, 2021

(30) Foreign Application Priority Data

Oct. 29, 2019 (JP) ..... JP2019-196207

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 3/3688* (2013.01); *G09G 3/3614* (2013.01); *G09G 3/3696* (2013.01); *G09G 2300/0426* (2013.01); *G09G 2310/0202* (2013.01); *G09G 2310/0281* (2013.01); *G09G 2310/0283* (2013.01); *G09G 2310/0286* (2013.01); *G09G 2310/08* (2013.01); *G09G 2320/0626* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 6,100,865 | A | 8/2000 | Sasaki | |
| 6,862,013 | B2 | 3/2005 | Takeuchi et al. | |
| 8,106,875 | B2 | 1/2012 | Maeda | |
| 2002/0140650 | A1* | 10/2002 | Kai | G09G 3/3688 345/87 |
| 2007/0182442 | A1* | 8/2007 | Hata | G09G 3/006 324/750.3 |
| 2009/0046112 | A1 | 2/2009 | Hirao et al. | |
| 2020/0020293 | A1* | 1/2020 | Zhang | G09G 3/006 |

FOREIGN PATENT DOCUMENTS

| | | | |
|---|---|---|---|
| JP | H10-097203 | A | 4/1998 |
| JP | 2001-041852 | A | 2/2001 |
| JP | 2002-108310 | A | 4/2002 |
| JP | 2010-066719 | A | 3/2010 |
| JP | 2010-243643 | A | 10/2010 |
| JP | 2010-243644 | A | 10/2010 |
| JP | 2011-064880 | A | 3/2011 |
| WO | 2007-108161 | A1 | 9/2007 |

* cited by examiner

*Primary Examiner* — Andre L Matthews
(74) *Attorney, Agent, or Firm* — Studebaker & Brackett PC

(57) ABSTRACT

A display apparatus includes: an inspection TFT of which a drive output of a gate driver circuit is connected to a gate electrode and a drive output of a source driver circuit is connected to a source electrode; and an abnormality detection circuit unit that receives an output from a drain electrode of the inspection TFT to detect an abnormality of the gate driver circuit or the source driver circuit, and, in a period in which the drive output of the gate driver circuit is high, the abnormality detection circuit unit determines as abnormal when an output voltage from the drain electrode of the inspection TFT is out of a predetermined voltage range.

9 Claims, 8 Drawing Sheets

ELECTRO-OPTICAL APPARATUS

BACKGROUND OF THE INVENTION

Field of the Invention

The present disclosure relates to an electro-optical apparatus, and can be suitably used particularly for a display apparatus having a function of detecting abnormal operation.

Description of the Background Art

In recent years, in addition to conventional navigation apparatuses as in-vehicle devices, use applications of a liquid crystal display apparatus increases to applications such as instrument panels, which are instrument panels such as speedometers and warning lamps that are installed in dashboards, and back monitors that display images behind the vehicle. Accordingly, importance of information displayed on a mounted display apparatus when a driver drives a vehicle is increasing.

In particular, ISO26262, which is an international standard for functional safety related to electric/electronics of automobiles, has been established, and the function of detecting an abnormality in display operation is important.

In general, a liquid crystal display apparatus includes a gate driver IC (scanning signal line drive circuit) that drives a gate wiring for controlling ON/OFF of a pixel thin film transistor (TFT) that controls charging of a pixel, and a source driver IC (image signal line drive circuit) that drives a data wiring for supplying electric charges to each pixel (WO 2007/108161).

It is considered that one of the causes of abnormal display operation is abnormal operation of the source driver IC or the gate driver IC. As means to detect this abnormality, it is possible to indirectly check the output to each pixel to check the normal operation of the source driver IC and the gate driver IC. For example, there are a method of actually operating a liquid crystal display apparatus and checking that there is no display abnormality by visual checking or using a camera, and a method of adding a photo sensor or a capacitance sensor to each pixel to directly determine the state of the pixel itself (Japanese Patent Application Laid-Open No. 2001-41852). However, in the known example, a large time delay occurs in order to check the operation abnormality. Furthermore, it is necessary to attach a sensor to every pixel.

As described above, it is not realistic for the display apparatus to actually check a display screen by visual checking or using a camera to continue monitoring the product in order to check in real time that there is no abnormality in the source driver IC and the gate driver IC. Furthermore, there is concern that, when adding a photo sensor or a capacitance sensor, the increase in the failure rate due to the shape change of the liquid crystal display apparatus due to the addition of parts and the circuit complexity, and the increase in power consumption due to the decrease in the transmittance of the liquid crystal panel due to the addition of sensors.

SUMMARY

The present disclosure has an object to improve an abnormal operation detection rate with a simple structure and a short delay time in an electro-optical apparatus.

An electro-optical apparatus according to the present disclosure includes: an array substrate including a display region in which scanning signal lines and image signal lines are arranged in a matrix, and pixel switch elements and pixel electrodes are formed at intersections of the scanning signal lines and the image signal lines, respectively; an electro-optical layer arranged corresponding to the display region; and a scanning signal line drive circuit that drives the scanning signal lines, and an image signal line drive circuit that drives the image signal lines, the scanning signal line drive circuit and the image signal line drive circuit being arranged in a peripheral portion of the display region. The electro-optical apparatus further includes: an inspection switch element of which a control electrode is connected to a drive output of the scanning signal line drive circuit, and one current electrode is connected to a drive output of the image signal line drive circuit; and an abnormality detection circuit unit that receives an output from another current electrode of the inspection switch element to detect an abnormality of the scanning signal line drive circuit or the image signal line drive circuit. The abnormality detection circuit unit outputs an abnormality signal when an output voltage from the another current electrode of the inspection switch element is outside a predetermined voltage range during an activation period of the drive output of the scanning signal line drive circuit.

According to the present disclosure, it is possible to detect whether there is an abnormality in operation of the scanning signal line drive circuit and the image signal line drive circuit. Therefore, the failure detection rate of the scanning signal line drive circuit and the image signal line drive circuit can be improved.

These and other objects, features, aspects and advantages of the present disclosure will become more apparent from the following detailed description of the present disclosure when taken in conjunction with the accompanying drawings.

DESCRIPTION OF THE PREFERRED EMBODIMENTS

Figure 1:
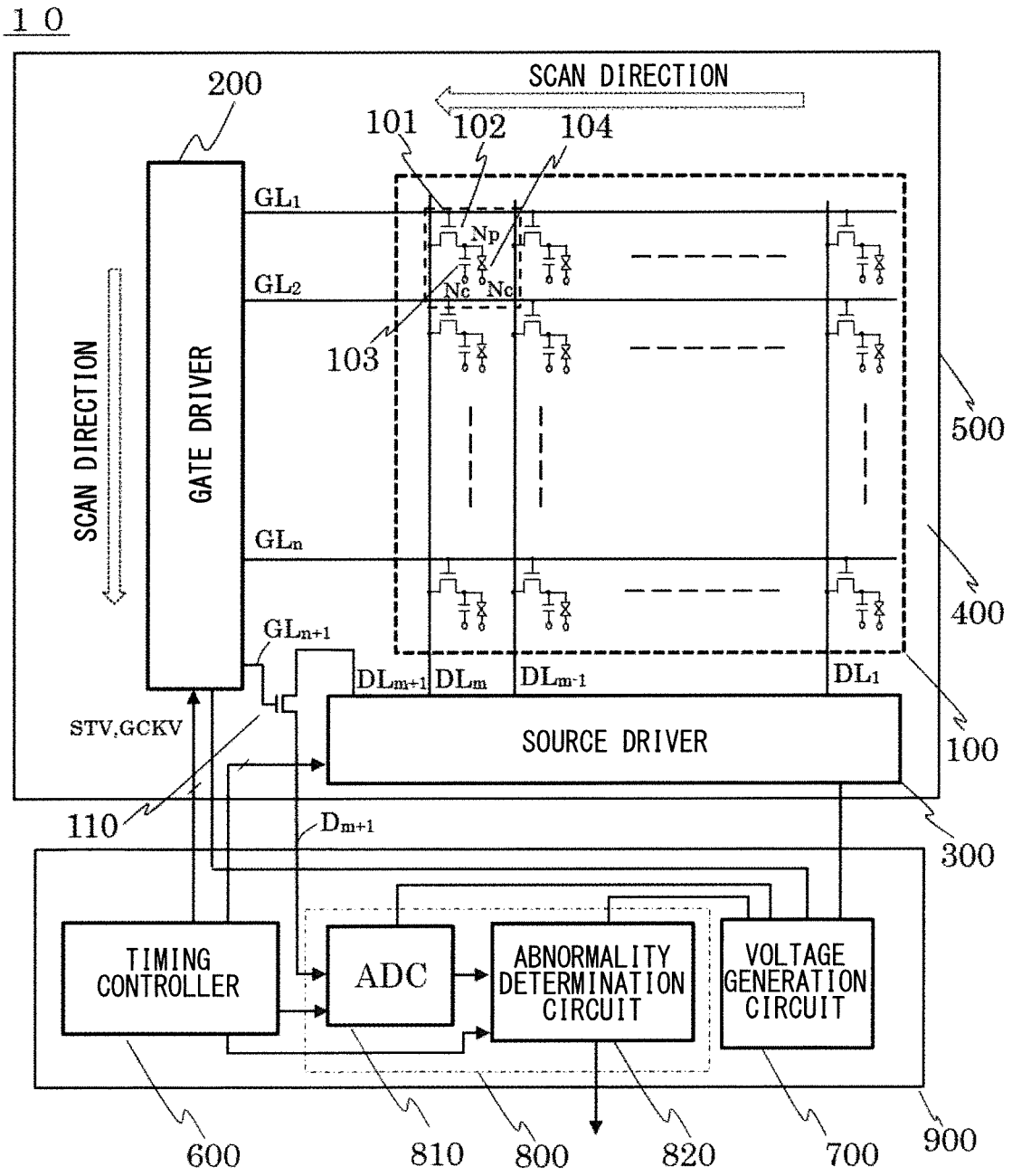
FIG. 1 is a schematic block diagram illustrating a configuration of a display apparatus according to a first preferred embodiment.

Hereinafter, preferred embodiments of the present disclosure will be described with reference to the drawings. Note that the drawings are schematically illustrated, and for convenience of description, the configuration is omitted or the configuration is simplified as appropriate. The mutual relationship between the sizes and the positions of the configurations and the like illustrated in different drawings is not necessarily described accurately and may be changed as appropriate.

In the following description, the similar components are designated by the same reference numerals, and this is similar for their names and functions. Therefore, detailed descriptions thereof may be omitted to avoid redundancy.

First Preferred Embodiment

FIG. 1 is a schematic block diagram illustrating a configuration of a display apparatus according to the present disclosure, and illustrates a configuration of a liquid crystal display apparatus 10 that employs a liquid crystal panel 500 as a representative example of the display apparatus. As illustrated in FIG. 1, the display apparatus according to the present preferred embodiment includes a display panel 500, a liquid crystal drive substrate 900, and an FPC (not shown) that connects both of the display panel 500 and liquid crystal drive substrate 900. The liquid crystal drive substrate 900 includes therein a timing controller 600, a voltage generation circuit 700, an analog digital conversion circuit 810 (denoted as ADC), and an abnormality detection circuit unit 800. The display panel 500 includes: an array substrate 400 including a liquid crystal display unit 100 (display region), a gate driver IC 200 (scanning signal line drive circuit), and a source driver IC 300 (image signal line drive circuit); and a color filter substrate (not shown).

The liquid crystal panel 500 provided with the liquid crystal display unit 100 further includes a color filter substrate (not shown) provided with a black matrix and a color filter (and a common electrode depending on the liquid crystal display mode), and has a liquid crystal element 104 in a gap between the liquid crystal panel 500 and the array substrate 400 facing the liquid crystal panel 500.

The liquid crystal display unit 100 includes a plurality of pixels 101 arranged in a matrix. Gate lines GL1, GL2, . . . , GLn (generally referred to as "gate lines GL" or scanning signal lines) are provided in each of pixel rows (also referred to as "pixel lines"), and data lines DL1, DL2, . . . , DLm (generally referred to as "data lines DL" or image signal lines) are provided in each of pixel columns (also referred to as "pixels columns"). That is, the pixel 101 is formed near each intersection of the gate lines GL and the data lines DL orthogonal to the gate lines GL. Note that the gate line numbers 1 to n and the data line numbers 1 to m are assigned in the order of scanning, and the directions are indicated by arrows in FIG. 1.

Each pixel 101 has a pixel TFT (pixel switch element) 102 provided between corresponding data line DL and pixel node Np (pixel electrode), a capacitor 103 connected in parallel between the pixel node Np and a common electrode node Nc, and a liquid crystal element 104. The orientation in the liquid crystal element 104 changes according to the voltage difference between the pixel node Np and the common electrode node Nc, and in response to this change, the display brightness of each pixel 101 changes. This makes it possible to control the brightness of each pixel by the display voltage transferred to the pixel node Np via the data line DL and the pixel TFT 102. That is, by applying an intermediate voltage difference between the voltage difference corresponding to the maximum brightness and the voltage difference corresponding to the minimum brightness across the pixel node Np and the common electrode Nc, intermediate brightness can be obtained. Accordingly, stepwise brightness can be obtained by setting the display voltage stepwisely.

A drive circuit that supplies a signal for driving the liquid crystal display unit 100 is provided in the peripheral portion of the liquid crystal display unit 100 having the above-described structure. The drive circuit includes the gate driver IC 200 and the source driver IC 300. The liquid crystal drive substrate 900 includes therein an abnormality detection circuit unit 800 that detects an abnormality of a gate signal or a source signal, and the abnormality detection circuit unit 800 includes an analog digital conversion circuit 810 and an abnormality determination circuit 820. The liquid crystal drive substrate 900 further includes a timing controller 600 that controls the gate driver IC 200, the source driver IC 300, and the abnormality detection circuit unit 800, and a voltage generation circuit 700 that supplies a potential to the gate driver IC 200, the source driver IC 300, and the abnormality detection circuit unit 800.

First, the timing controller 600 receives an external control signal including a video signal from an external graphic controller (not shown), a vertical synchronizing signal which is a frame distinguishing signal, a horizontal synchronizing signal, and an external clock signal, and generates and outputs a control signal for controlling operation of the gate driver IC 200 and the source driver IC 300.

The voltage generation circuit 700 generates various drive voltages required for driving the display apparatus. A voltage generation unit (not shown) in the voltage generation circuit 700 generates a source driver power, a gate high voltage and a gate low voltage, and a common voltage (Vcom). The voltage generation circuit 700 applies the gate high voltage and the gate low voltage to the gate driver IC 200, and supplies the data line output circuit power to the source driver IC 300. Here, the data line output circuit power is used as a basic voltage for generating a reference voltage (gradation signal) VREF for driving the liquid crystal.

The source driver IC 300 includes a shift register unit having plural stages, a data register unit, a latch circuit unit, and a plurality of output stage units including a D/A conversion function. The source driver IC 300 sequentially captures the pixel data signal to the data register unit on the basis of the control signal of the timing controller 600, and D/A converts the pixel data signal based on the reference voltage generated from the data line output circuit power of the voltage generation circuit 700 to generate a gradation signal. The gradation signal is supplied to each of the data lines DL1 to DLm. That is, the source driver IC 300 converts the digital pixel data signal input to the display apparatus to an analog gradation signal by using the reference voltage VREF.

Then, the source driver IC 300 supplies the converted gradation signal from the output stage unit to the plurality of data lines DL1 to DLm in the liquid crystal display unit 100, and drives these lines. As the source driver IC 300, an integrated circuit (IC) that is compatible to a mounting method called chip on glass (COG) is generally used.

The timing controller 600 generates a vertical synchronization start signal (hereinafter, referred to as "start signal") STV and a drive clock signal GCLK, and supplies them to the gate driver IC 200.

The gate driver IC 200 includes a cascaded shift register having plural stages and an output stage thereof, and supplies a gate high signal VGH (activation level) and a gate low signal VGL (deactivation level) from the output stage to the plurality of gate lines GL1 to GLn in the liquid crystal display unit 100 on the basis of the start signal STV, the gate clock signal GCKV, the gate high voltage, and the gate low voltage. The gate high signal VGH is a signal in the form of a single pulse that is sequentially supplied to the plurality of gate lines GL1 to GLn from the output stage of the shift register having plural stages, and these are referred to as gate signals G1 to Gn.

Figure 2A:
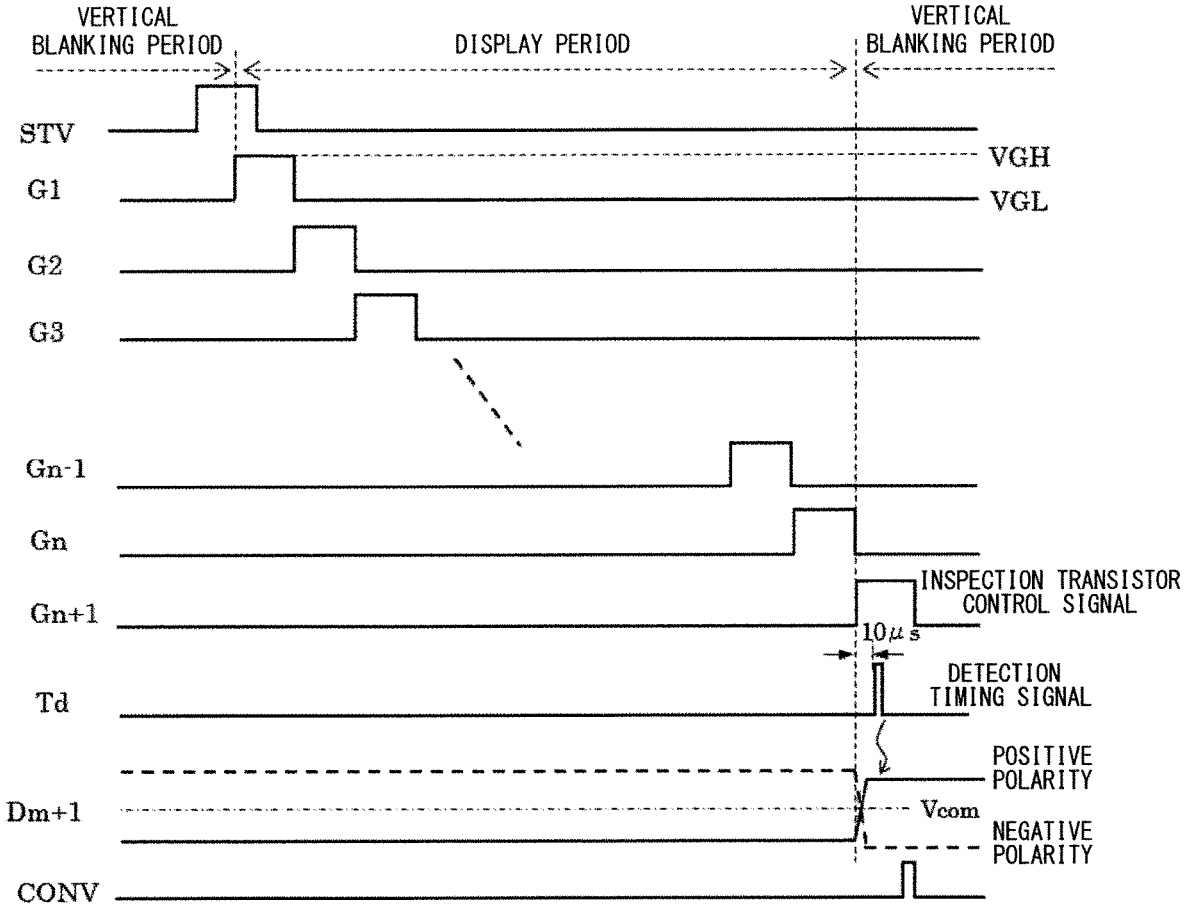
FIGS. 2A and 2B are timing charts at the time of abnormality detection according to the first preferred embodiment.

As shown by the gate signals G1 to Gn in of FIG. 2A, the gate high signal VGH is a signal sequentially supplied to the gate lines GL1 to GLn during one horizontal clock period (1H). When the gate high signal VGH is supplied to the gate lines GL1 to GLn, the pixel TFTs 102 connected to the gate lines GL1 to GLn are turned on, the voltage that has been applied to the data lines DL1 to DLm by the source driver IC 300 is written on the pixels 101, and an image is displayed.

As described above, in the first preferred embodiment, the liquid crystal display unit 100 of the liquid crystal panel 500 has a resolution of n rows×m columns, and uses n gate lines (GL1 to GLn) and m data lines (DL1 to DLm) to matrix-drive the liquid crystal display unit 100. As illustrated in FIG. 1, in the present preferred embodiment, an inspection transistor 110 is further provided as an inspection switch element in the lower left corner of the array substrate 400 outside the display unit. This inspection transistor 110 is a thin film transistor (TFT) formed on the array substrate 400 at the same time and through the same process as the pixel TFT 102. As described above, since the inspection transistor 110 can be manufactured in the same array process, it is not necessary to add a discrete transistor.

In the present preferred embodiment, a connection line that takes out the outputs of the gate driver IC 200 and the source driver IC 300 and connects to the electrode of the inspection transistor 110 is further provided. These connection lines are taken out from the output stage GLn+1 which is the next stage to the gate line GLn at the final stage and the output stage DLm+1 which is the next stage to the data line DLm at the final stage with respect to the scan direction. That is, the control electrode of the inspection transistor 110 is connected to the output stage GLn+1 of the n+1-th gate driver IC 200 in the scan direction, and the source electrode of the inspection transistor 110 is connected to the output stage DLm+1, which is the m+1-th drive output of the source driver IC 300 in the scan direction. That is, the control electrode of the inspection transistor 110 is connected to the n+1-th output stage GLn+1, and the source electrode (one current electrode) is connected to the m+1-th output stage DLm+1. The output from the drain electrode (another current electrode) of the inspection transistor 110 is connected to the analog digital conversion circuit 810 in the abnormality determination circuit unit 800.

Next, FIG. 2A illustrates the timing of the signal taken out for the inspection when the resolution of the gate line GL is n. After receiving the start pulse STV, the gate driver IC 200 sequentially outputs the gate high signal VGH to the gate line GL in accordance with the scan direction (see the (gate signals G1 to Gn) waveforms), and correspondingly, a signal for driving the pixel 101 is supplied from the output stage of the source driver IC 300 to the data line DL according to the image data, and the liquid crystal display unit 100 is matrix-driven.

After that, in the present preferred embodiment, as illustrated in the waveform diagram of the inspection transistor control signal Gn+1 in FIG. 2A, in the vertical blanking period, the inspection transistor control signal Gn+1 is output from the output stage GLn+1 which is the n+1-th drive output of the gate driver IC 200, and the gate high signal VGH is output over one horizontal period (activation period). At this time, the inspection transistor output Dm+1 is applied as the inspection signal output from the source driver IC 300 to the output stage DLm+1 connected to the source electrode of the inspection transistor 110. The voltage value of the output voltage of this inspection transistor output Dm+1 changes for each frame to check whether the source driver IC 300 is functioning normally and the output voltage changes sequentially in accordance with image data to be input.

Figure 2B:
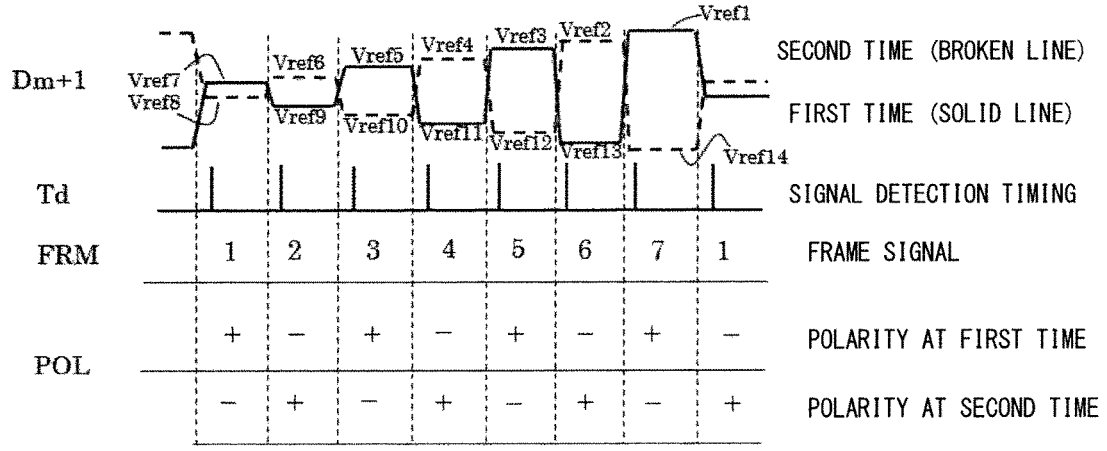

In the present preferred embodiment, not only the positive polarity and the negative polarity are switched every other frame as shown in the inspection transistor output Dm+1 waveform of FIG. 2A, but also, as illustrated in FIG. 2B, as the frame number FRM is incremented to the first frame, the second frame, . . . , the seventh frame in every vertical cycle, the peak value of the output of the inspection transistor output Dm+1 increases. Here, the peak value of the inspection transistor output Dm+1 has fourteen types of reference voltages (Vref1 to Vref14) for generating the gradation voltage input to the source driver IC 300. Not only the positive polarity and negative polarity are switched every other frame according to an alternating polarity signal POL (not shown), but the positive polarity and the negative polarity in each frame are switched also between the first measurement (same for odd number measurement) and the second measurement (same for even number measurement). As illustrated in FIG. 2B, here, Vref8 to Vref14 are reference voltages for negative polarity.

Next, in FIGS. 2A and 2B, as shown by the detection timing signal Td, the voltage measurement of the inspection transistor output Dm+1 is performed a predetermined time after the start of vertical blanking. This is to ensure a sufficient voltage stabilization time for rising/falling of the waveform, since the polarity of the inspection transistor output Dm+1 is switched for each frame. In the present preferred embodiment, as illustrated in FIG. 2A, 10 μs (microseconds) is ensured as the voltage stabilization time.

Figure 3:
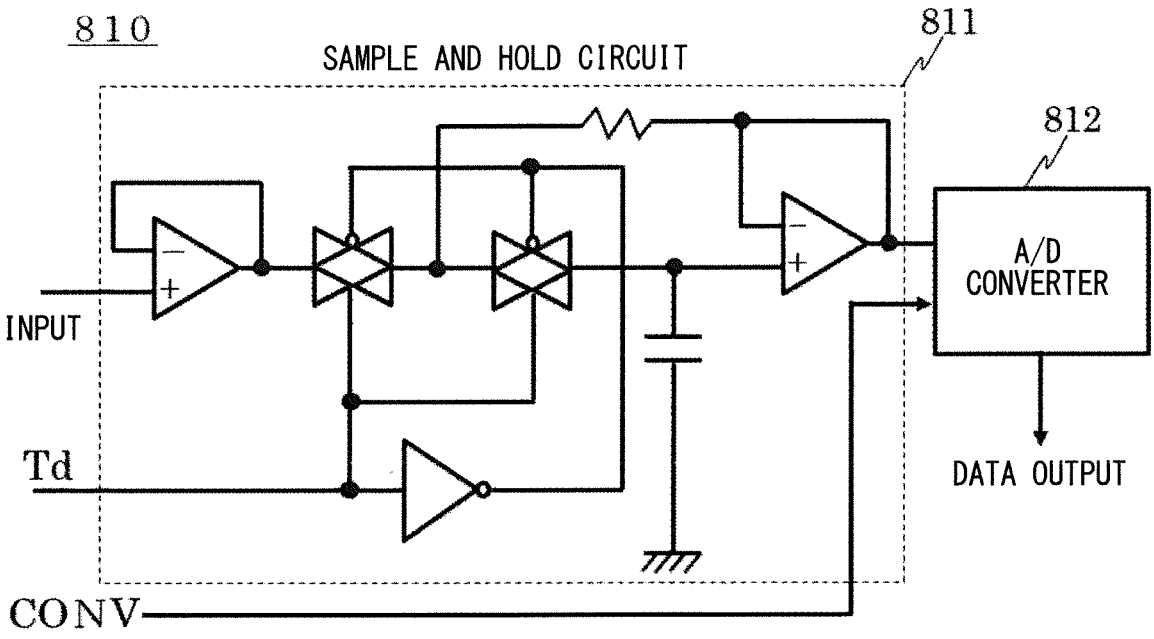
FIG. 3 is a configuration diagram of an analog digital conversion circuit in FIG. 1.

Next, the abnormality detection circuit unit 800 employed in the present preferred embodiment will be described in detail. As illustrated in FIG. 1, the abnormality detection circuit unit 800 is arranged in the liquid crystal drive substrate 900, and includes the analog digital conversion circuit 810 and the abnormality determination circuit 820. As illustrated in FIG. 3, the analog digital conversion circuit 810 includes a sample and hold circuit 811 and an analog digital converter 812.

The sample and hold circuit 811 samples and holds the inspection transistor output Dm+1 signal to be input from the drain electrode of the inspection transistor 110 with the detection timing signal Td illustrated in FIG. 2B by the analog switch and capacitance in the sample and hold circuit 811, and outputs the result to the analog digital converter 812. Next, the analog digital converter 812 to which the inspection transistor output Dm+1 has been input performs analog digital conversion of the voltage value of the inspection transistor output Dm+1 on the basis of a conversion command CONV, and outputs the result to the abnormality determination circuit 820.

Next, in the abnormality determination circuit 820 to which the inspection transistor output Dm+1 has been input, a reference value (digital value) obtained by analog digital converting the basic voltage (analog value) of fourteen types of reference voltages (Vref1 to Vref14) corresponding to the frame number FRM and the alternating polarity signal POL is compared with the output value (digital value) of the analog digital conversion circuit 810.

If the absolute value of the difference is within a predetermined range, it is determined as "no abnormality", and if it exceeds the predetermined range, it is determined as "abnormality".

In the present preferred embodiment, as the range of "no abnormality", a certain digital value that is equivalent to ±100 mV when the data line output circuit power is 10 V is set in consideration of an output voltage deviation of the source driver IC 300, voltage drop from the output of the source driver IC 300 to the inspection transistor 110 and the analog digital conversion circuit 810, conversion accuracy of the analog digital conversion circuit 810, and the like.

As described above, in this example, the digital value as the "predetermined range" is set in consideration of the output voltage deviation of the source driver IC 300, voltage drop from the output of the source driver IC 300 through the inspection transistor 110 to the analog digital conversion circuit 810, the conversion accuracy of the analog digital conversion circuit 810, but if only the non-operation of the gate driver IC 200 or the source driver IC 300 is detected, the range of "no abnormality" may be set wide. In this example, the "predetermined range" is set to one value regardless of the fourteen types of basic voltages, but may be set individually for each of the fourteen types of basic voltages.

Figure 4:
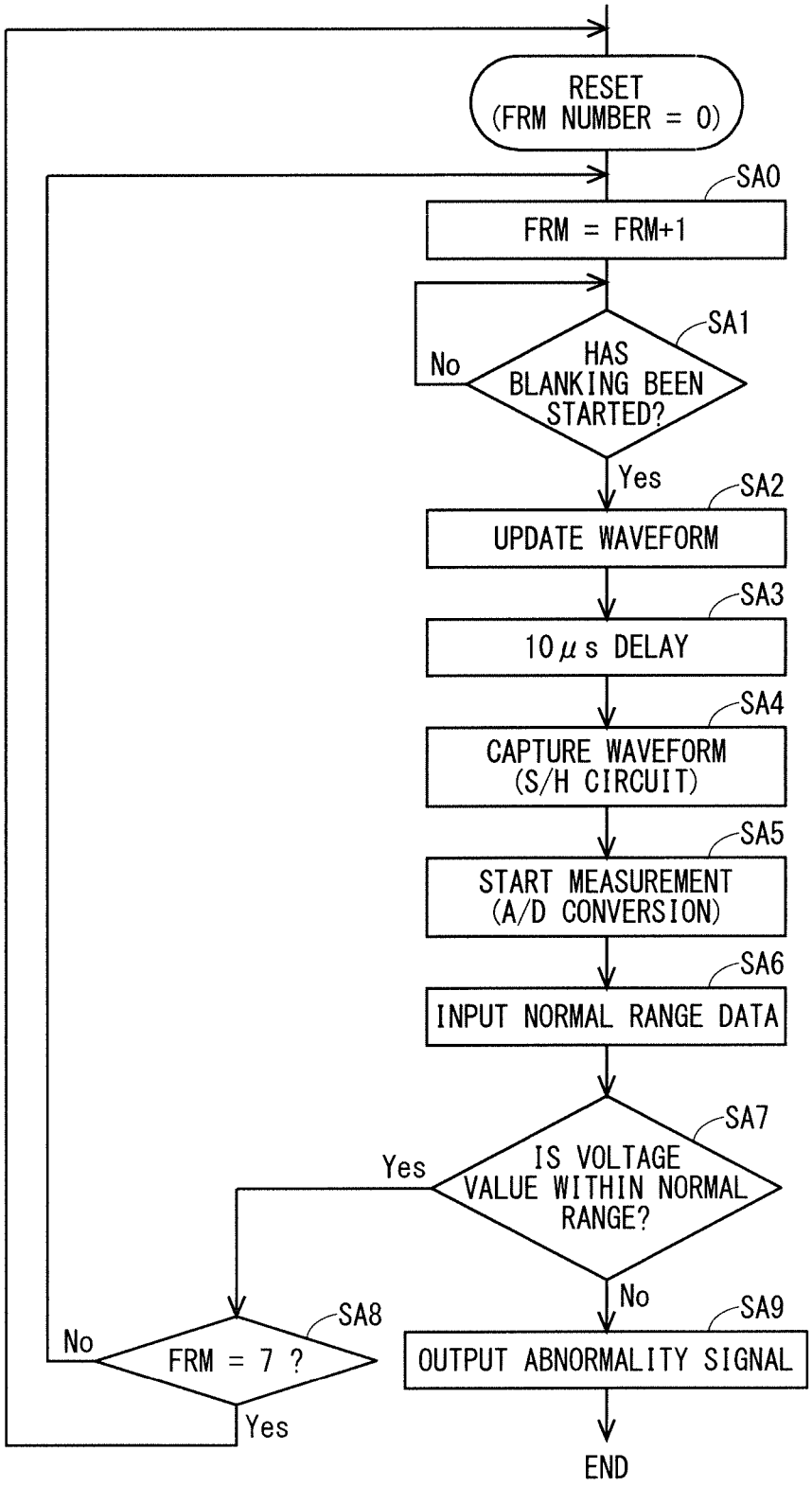
FIG. 4 is a flowchart diagram for explaining abnormality determination operation of an abnormality determination circuit unit in FIG. 1.

Next, the abnormality determination operation of the abnormality determination circuit 820 will be described in detail with reference to the flowchart shown in FIG. 4. First, in step SA0 from the reset state (frame number is zero), the frame number is updated and incremented by one. Next, in step SA1, the start of vertical blanking input from the timing controller 600 is detected. At the same time as the start of vertical blanking, the timing controller 600 outputs the inspection transistor control signal Gn+1 for abnormality determination and a signal output command for the inspection transistor output Dm+1 to the gate driver IC 200 and the source driver IC 300. In response thereto, the output stage GLn+1 of the gate driver IC 200 outputs the inspection transistor control signal Gn+1 to the line connected thereto, the control electrode of the inspection transistor 110 becomes the VGH level for one horizontal period, and the inspection transistor 110 is turned on for one horizontal period. The inspection transistor output Dm+1 signal corresponding to the frame number FRM and the alternating polarity signal POL is applied to the output stage DLm+1 of the source driver IC 300 (step SA2).

In order to wait for the output of the inspection transistor output Dm+1 to stabilize, in step SA3, after waiting for 10 μs, when the detection timing signal Td is input from the timing controller 600 to the sample and hold circuit 811 in step SA4, the inspection transistor output Dm+1 voltage at that time is held and output to the analog digital converter 812.

Next, in step SA5, the conversion command CONV is input from the timing controller 600 to the analog digital converter 812 after a predetermined time has elapsed, the inspection transistor output Dm+1 voltage held by the sample and hold circuit 811 is subjected to analog digital conversion in the analog digital converter 812, and the digital value according to the inspection transistor output Dm+1 voltage is transferred to the abnormality determination circuit 820.

In the abnormality determination circuit 820, in step SA6, the reference value (digital value) corresponding to fourteen types of reference voltages (Vref1 to Vref14) corresponding to the frame number FRM and the alternating polarity signal POL is input from the timing controller 600. Therefore, in step SA7, the reference value (digital value) and the output value (digital value) of the analog digital conversion circuit 810 are compared with each other, it is determined whether the absolute value of the difference is equal to or less than a value equivalent to 100 mV, and if it is equal to or less than the value, it is determined as "no abnormality", and if it exceeds the value, it is determined as "abnormality".

When it is determined in step SA7 as "abnormality", an abnormality signal is output to the timing controller 600 in step SA9, which causes the external graphic controller (not shown) to start the abnormality processing. On the other hand, if it is determined as "no abnormality" in step SA7, it is determined in step SA8 whether the frame number is seven or not, and if it is seven, the state returns to the reset state, the frame number is initialized, and remeasurement is started. If the frame number is less than seven, the process proceeds to step SA0, the frame number is incremented by one, and the measurement in the next frame is started.

Second Preferred Embodiment

Figure 5:
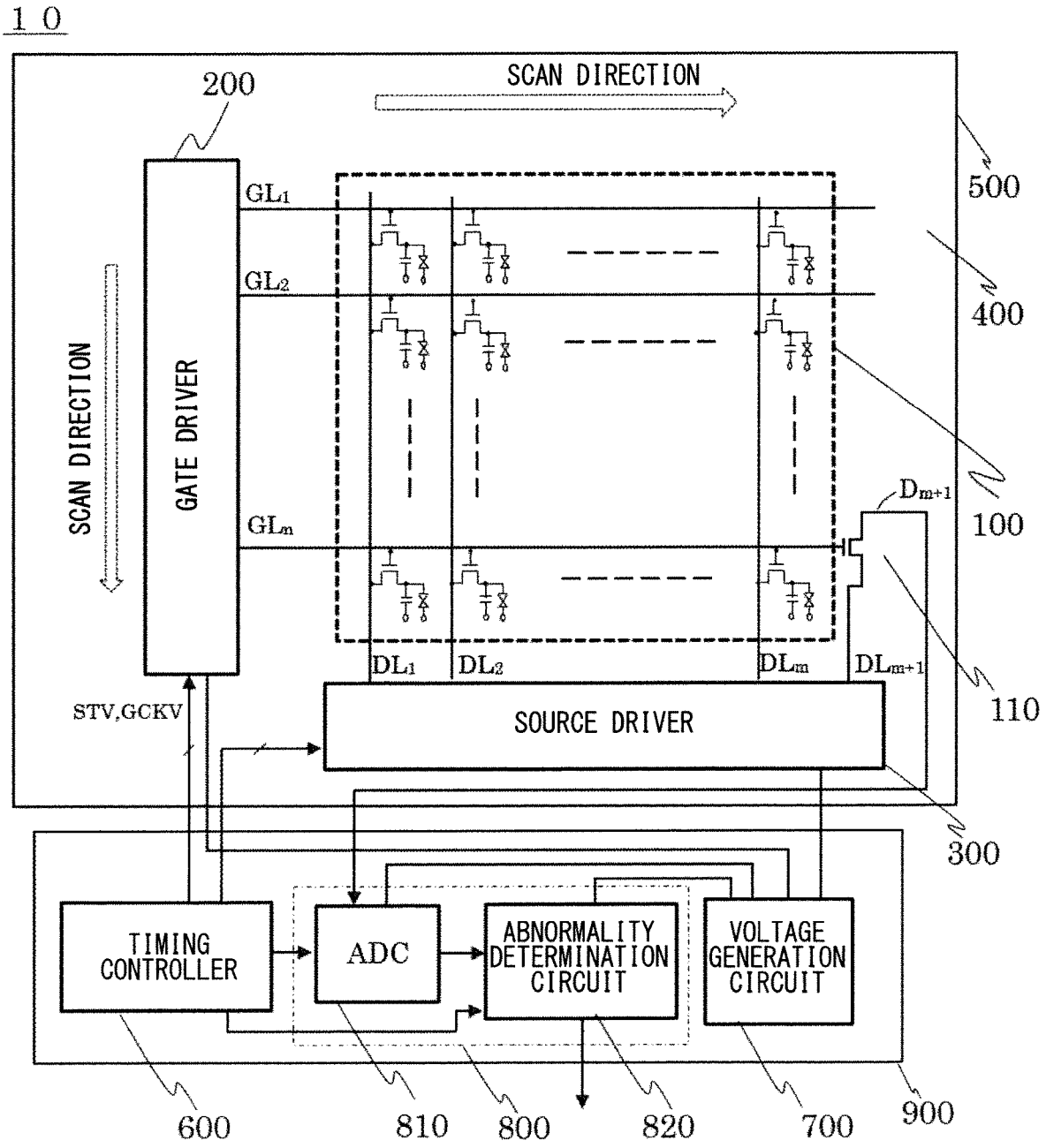
FIG. 5 is a schematic block diagram illustrating a configuration of a display apparatus according to a second preferred embodiment.

FIG. 5 is a schematic block diagram illustrating a configuration of a display apparatus according to a second preferred embodiment. Other configurations and operations are similar to those in the above-described first preferred embodiment, and therefore detailed description thereof will be omitted here.

As illustrated in FIG. 5, in the second preferred embodiment, the control electrode of the inspection transistor 110 arranged at the lower right corner of the array substrate 400 is connected to the n-th gate line GLn, and the source electrode is connected to the m+1-th output stage DLm+1. As a result, unlike the above-described first preferred embodiment, the n+1-th output stage number of the gate driver IC 200 is not necessary, and it is not necessary to increase the number of output stages driven by the gate driver IC 200 to the resolution n or more. Furthermore, since the inspection transistor 110 can be manufactured in the array process, it is not necessary to add a discrete transistor.

As described above, since the control electrode of the inspection transistor 110 is connected to the n-th gate line GLn, a series of abnormality detection operation by the abnormality detection circuit unit 800 is performed in a period in which the output of Gn becomes the potential of VGH, that is, during the horizontal scanning period of the n-th row of the liquid crystal display unit 100. The abnormality detection operation period by the abnormality detection circuit unit 800 is the same as that of the above-described preferred embodiment, except that the abnormality detection operation period is during the horizontal scanning period of the n-th row, not the vertical blanking period, and detailed description thereof is omitted.

As described above, in the present preferred embodiment, the control of the control electrode of the inspection transistor 110 and the control of the n-th row pixel TFT 101 are combined, but n pixels TFTs 101 are connected to the n-th gate line GLn, and therefore, even if one more inspection transistor 110 is connected as a connection destination, the influence of the gate driver IC 200 on the driving of the gate line GLn is negligibly small. On the other hand, since the abnormality detection circuit unit 800 performs a series of abnormality detection operation during the horizontal scanning period of the n-th row, not during the vertical blanking period, the liquid crystal display unit 100 can be driven even during a short vertical blanking period.

Third Preferred Embodiment

Figure 6:
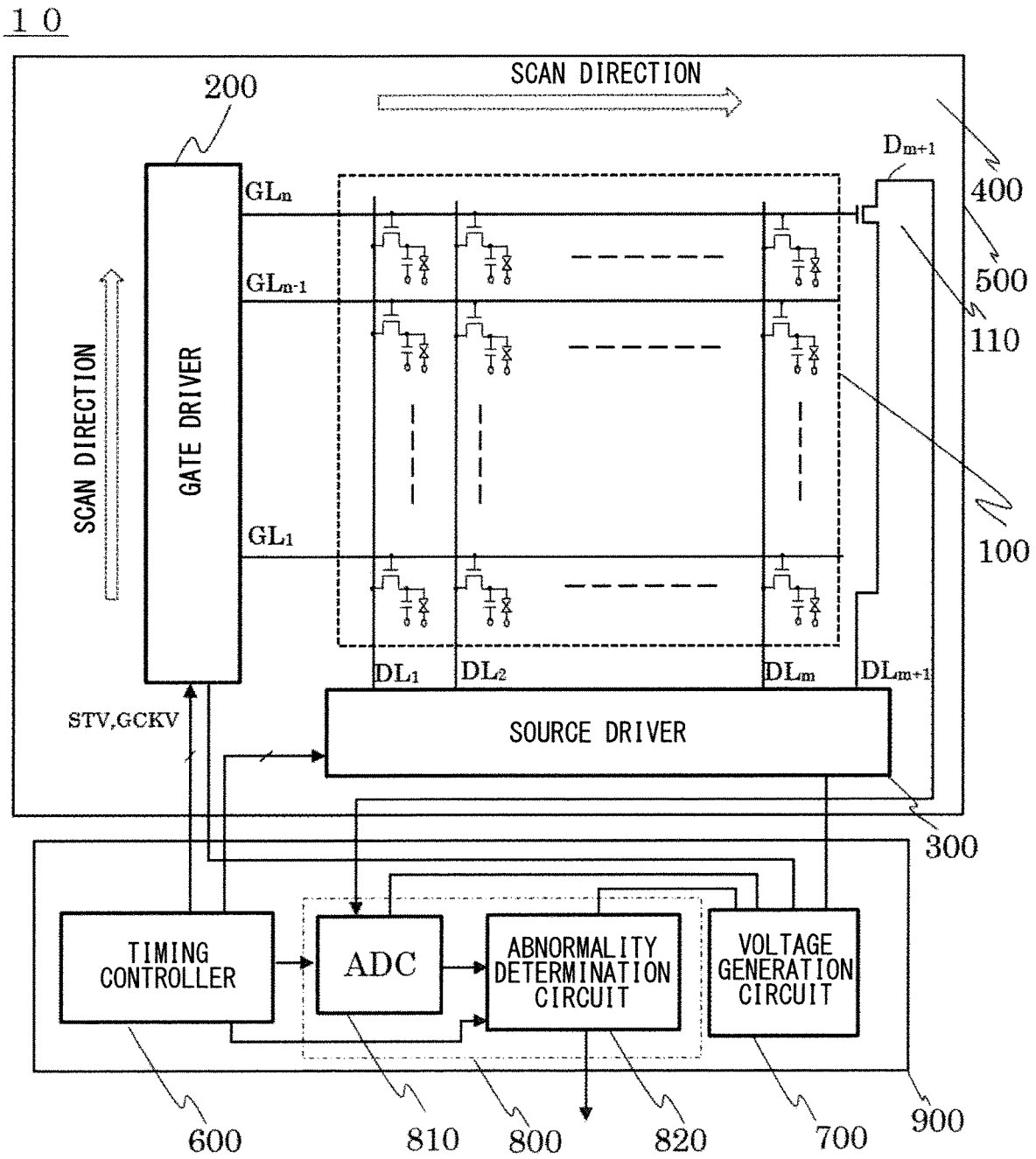
FIG. 6 is a schematic block diagram illustrating a configuration of a display apparatus according to a third preferred embodiment.

FIG. 6 is a schematic block diagram illustrating a configuration of a display apparatus according to a third preferred embodiment. In the present preferred embodiment, the liquid crystal display unit 100 has a configuration in which the inspection transistors 110 is arranged in correspondence with reverse scanning in the direction from lower side toward the upper side. Other configurations and operations are similar to those in the above-described first preferred embodiment, and therefore detailed description thereof will be omitted here.

As illustrated in FIG. 6, also in the third preferred embodiment, the control electrode of the inspection transistor 110 arranged at the upper right corner of the array substrate 400 is connected to the n-th gate line GLn, and the source electrode is connected to the m+1-th output stage DLm+1. As a result, unlike the above-described first preferred embodiment, the n+1-th output stage number of the gate driver IC 200 is not necessary, and it is not necessary to increase the number of gate lines driven by the gate driver IC 200 to the resolution n or more. Furthermore, since the inspection transistor 110 can be manufactured in the array process, it is not necessary to add a discrete transistor.

Fourth Preferred Embodiment

Figure 7:
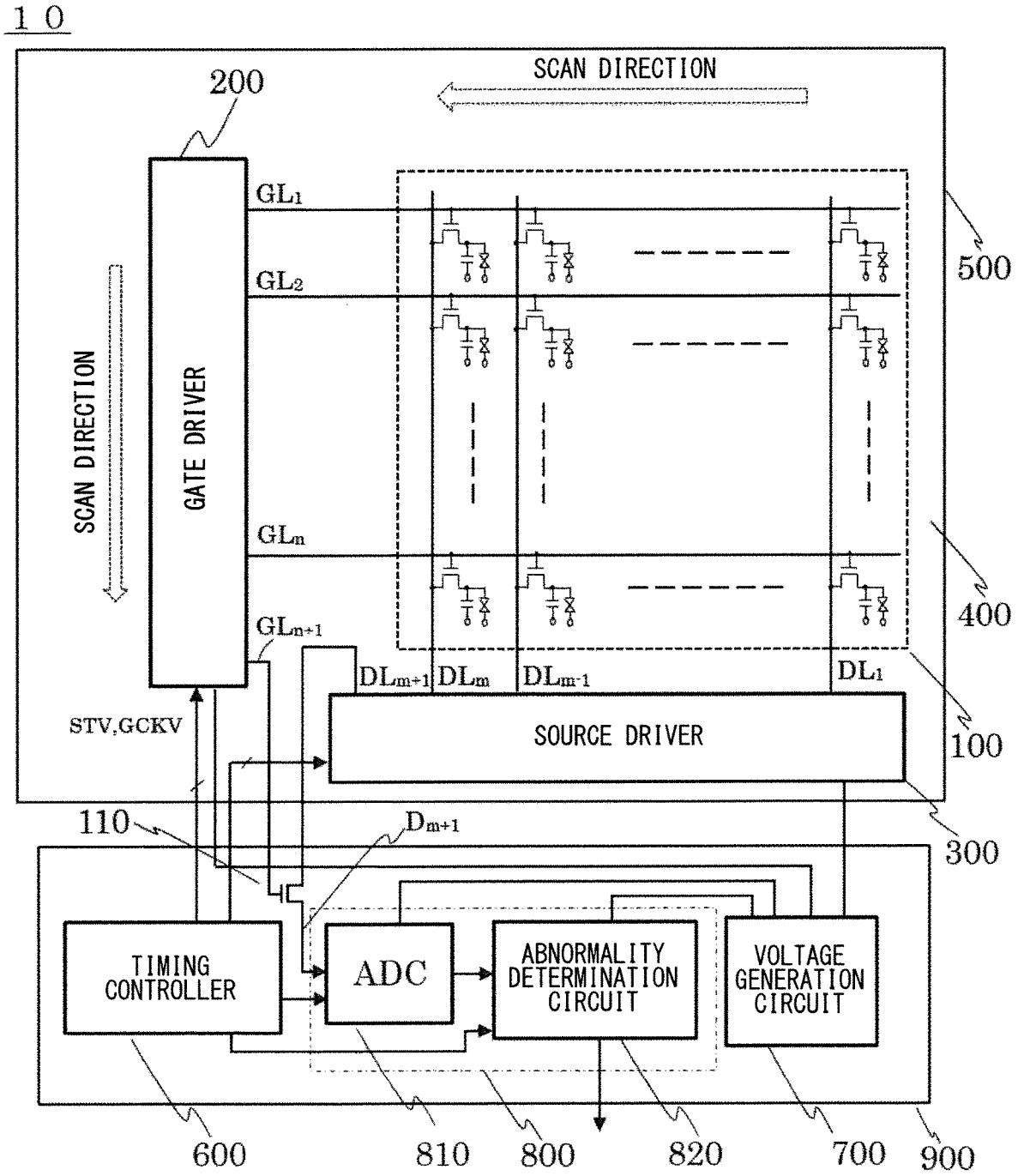
FIG. 7 is a schematic block diagram illustrating a configuration of a display apparatus according to a fourth preferred embodiment.

FIG. 7 illustrates a configuration of a fourth preferred embodiment. FIG. 7 illustrates a structure in which the inspection transistor 110 in the structure of FIG. 1 is a discrete transistor arranged on a substrate.

As illustrated in FIG. 7, a discrete transistor is provided on the liquid crystal drive substrate 900 as the inspection transistor 110. When applied to a liquid crystal display apparatus with a resolution of m×n, the control electrode of the inspection transistor 110 is connected to the output stage GLn+1 of the n+1-th gate driver IC 200 in the scanning direction, and the source electrode of the inspection transistor 110 is connected to the output stage DLm+1 of m+1-th the source driver IC 300 in the scanning direction. In general, a discrete transistor has a high breakdown voltage and a high resistance to static electricity from the outside, so that highly reliable abnormality detection can be performed.

<First Modification>

As a modification of the present preferred embodiment, a CMOS analog switch IC may be employed instead of the inspection transistor 110 provided on the liquid crystal drive substrate 900. In this case, the ON/OFF control signal of the analog switch has a too large ON/OFF amplitude in the drive output of the output stage GLn+1 by the gate driver IC 200, but it is sufficient that the voltage is resistance-divided and the level is shifted to an appropriate control signal voltage.

Fifth Preferred Embodiment

Figure 8:
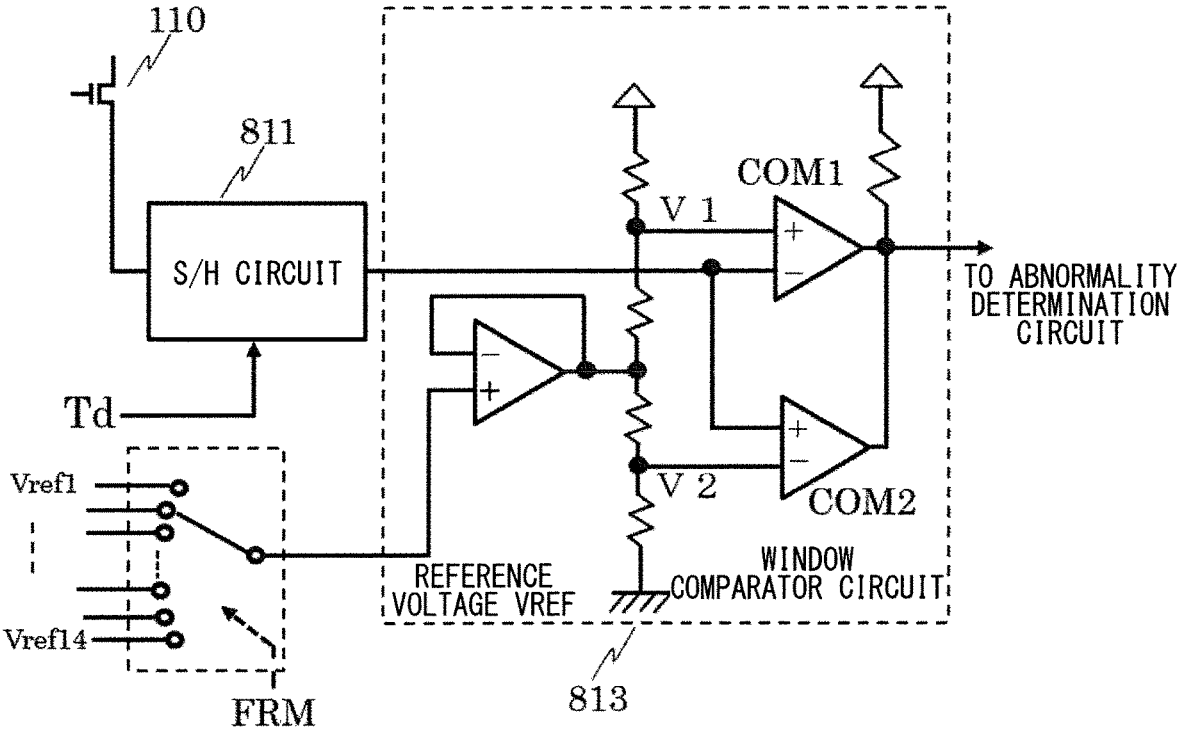
FIG. 8 is a schematic block diagram illustrating a configuration of an abnormality detection circuit unit according to the fourth preferred embodiment.

FIG. 8 is a schematic block diagram illustrating a configuration of an abnormality detection circuit unit 800 arranged in a display apparatus according to a fifth preferred embodiment. Other configurations and operations are similar to those in the above-described first preferred embodiment, and therefore detailed description thereof will be omitted here. As illustrated in FIG. 8, in the present preferred embodiment, instead of the analog digital conversion circuit 810 employed in the above-described first preferred embodiment, a sample and hold circuit 811 (denoted as S/H circuit) and a window comparator circuit 813 are employed.

The inspection transistor output Dm+1 of the inspection transistor 110 is sampled and held by the sample and hold circuit 811 at the timing of the detection timing signal Td, and input to one input terminal of the window comparator circuit 813. The reference voltage VREF is input to another input terminal of the window comparator circuit 813. As the reference voltage VREF, configuration is made such that one of the reference voltages corresponding to fourteen types (Vref1 to Vref14) corresponding to the frame number FRM and the alternating polarity signal POL as similar to the above-described first preferred embodiment is selected and input as appropriate by the VREF selection circuit 814.

In FIG. 8, the reference voltage VREF is input to the positive input side of the upper comparator COM1 as the input voltage V1, and input to the negative input side of the lower comparator COM2 as the input voltage V2. The input voltage V2 is a voltage generated as appropriate by resistance-dividing the input voltage V1. Note that the comparators COM1 and COM2 are comparators of open collector type output.

Here, at the timing of the detection timing signal Td, if the inspection transistor output Dm+1 that has been sampled and held by the sample and hold circuit 811 is equal to or greater than the input voltage V2 and equal or less than the input voltage V1, the output of the window comparator circuit 813 is L. If the inspection transistor output Dm+1 that has been sampled and held by the sample and hold circuit 811 is equal to or less than the input voltage V2 or equal to or greater than the input voltage is V1, the output of the window comparator circuit 813 is H. This abnormal signal is output to an external graphic controller, and the external graphic controller performs predetermined abnormal processing.

Note that, although the gate driver IC 200 employed in the above-described first to fourth preferred embodiments is an integrated circuit employing a crystalline silicon transistor, the gate line drive circuit used in the present disclosure may have a configuration in which a shift register circuit employing a low temperature polysilicon TFT or an amorphous silicon TFT is directly formed on a glass substrate.

In the above-described first to fourth preferred embodiments, as the scan direction (scanning direction) of the gate driver IC and the source driver IC, only a case of one direction of from the upper side to the lower side (gate driver) and from the left side to the right side or from the right side to the left side (source driver) in a preferred embodiment is shown. However, a reverse scan function is known in which the scan directions of the gate driver IC and the source driver IC can be switched by a switching command from the outside of the display apparatus. In this case, the abnormality determination can be performed regardless of the scanning direction of each driver described above, by a configuration in which four inspection transistors connected to the outputs of the final output stage or the subsequent stages of each driver are formed at the corners outside the display unit on the array substrate, the output from the inspection transistor is appropriately selected and input to the abnormality determination circuit unit according to switching of the scanning direction of each driver described above. In this case, the influence on the display can be minimized by connecting the output of each driver, not the output connected to the display unit, but the remaining output adjacent thereto to the inspection transistor.

In the disclosure of the above-described first to fourth preferred embodiments, the liquid crystal display unit of the liquid crystal panel employed in the electro-optical apparatus has a resolution of n rows×m columns, but if color display using three-color pixels of R, G, and B is possible, the number of outputs of the source driver IC needs to be 3×m. In this case, the source electrode of the inspection transistor is connected to the 3m+1-th data line output DL3m+1.

On the other hand, in the disclosure of the above-described first to fourth preferred embodiments, as an example of the electro-optical apparatus, the content thereof is described by taking the liquid crystal display apparatus that employs the liquid crystal element 104 in the pixel 101 as the electro-optical layer. However, the preferred embodiments can also be applied to a matrix display apparatus that employs electroluminescence (EL), organic EL, plasma display, electronic paper, or the like as an electro-optical layer that converts electric signals into light brightness. Further, the preferred embodiments can be widely applied to electro-optical apparatuses such as an imaging apparatus (image sensor) that converts light intensity into an electric signal.

While the disclosure has been shown and described in detail, the foregoing description is in all aspects illustrative and not restrictive. It is therefore understood that numerous modifications and variations can be devised.

What is claimed is:

1. An electro-optical apparatus comprising:

an array substrate including a display region in which scanning signal lines and image signal lines are arranged in a matrix, and pixel switch elements and pixel electrodes are formed at intersections of the scanning signal lines and the image signal lines, respectively;

an electro-optical layer arranged corresponding to the display region; and a scanning signal line drive circuit that drives the scanning signal lines and an image signal line drive circuit that drives the image signal lines, the scanning signal line drive circuit and the image signal line drive circuit being arranged in a peripheral portion of the display region, the electro-optical apparatus further comprising:

an inspection switch element of which a control electrode is directly connected to a drive output of the scanning signal line drive circuit, and one current electrode is directly connected to a drive output of the image signal line drive circuit; and an abnormality detection circuit unit that receives an output directly from another current electrode of the inspection switch element to detect an abnormality of the scanning signal line drive circuit or the image signal line drive circuit, wherein the abnormality detection circuit unit outputs an abnormality signal when an output voltage from the another current electrode of the inspection switch element is outside a predetermined voltage range during an activation period of the drive output of the scanning signal line drive circuit.

2. The electro-optical apparatus according to claim 1, wherein the inspection switch element is formed in a same process as the pixel switch element.

3. The electro-optical apparatus according to claim 1, wherein the drive output of the scanning signal line drive circuit of a final stage or subsequent stages with respect to a scanning direction is connected to the inspection switch element, and a drive output of the image signal line drive circuit of a final stage or subsequent stages with respect to a scanning direction is connected to the inspection switch element.

4. The electro-optical apparatus according to claim 1, wherein the inspection switch element is connected to both a drive output of a scanning start side and a drive output of a scanning end side of the scanning signal line drive circuit, and to both a drive output of a scanning start side and a drive output of a scanning end side of the image signal line drive circuit, and an output of the inspection switch element selected according to switching of a scanning direction of the scanning signal line drive circuit and the image signal line drive circuit is input to the abnormality detection circuit unit.

5. The electro optical apparatus according to claim 1, wherein, of the drive output of the image signal line drive circuit, the drive output not connected to the display region is connected to one current electrode of the inspection switch element, and the drive output connected to the one current electrode of the inspection switch element changes for each frame.

6. The electro optical apparatus according to claim 1, wherein, abnormality detection by the abnormality detection circuit unit is performed within a vertical blanking period.

7. The electro-optical apparatus according to claim 1, wherein the drive output of the scanning signal line drive circuit of a final stage with respect to a scanning direction is connected to a control electrode of the inspection switch element.

8. The electro-optical apparatus according to claim 1, wherein the inspection switch element is a single transistor.

9. The electro-optical apparatus according to claim 1, wherein the control electrode of the inspection switch element receives an input directly from the scanning signal line driver circuit;

the one current electrode of the inspection switch element directly acquires a signal from the image signal line drive circuit; and the abnormality detection circuit unit receives an output directly from the another current electrode of the inspection switch element.

* * * * *